US005877380A

United States Patent [19]

Conroy et al.

[11] Patent Number: 5,877,380

[45] Date of Patent: Mar. 2, 1999

[54] QUENCH OIL VISCOSITY CONTROL IN PYROLYSIS FRACTIONATOR

[75] Inventors: Brendan Patrick Conroy, Houston; Vijender Kumar Verma, Sugarland, both of Tex.

[73] Assignee: The M. W. Kellogg Company, Houston, Tex.

[21] Appl. No.: 958,171

[22] Filed: Oct. 27, 1997

[51] Int. Cl.[6] ..... C07C 4/02; C10G 9/00; B01D 3/00

[52] U.S. Cl. ..... 585/650; 585/648; 585/802; 585/809; 208/353; 208/102; 203/1

[58] Field of Search ..... 585/648, 650, 585/802, 809; 208/353, 102, 104; 203/1

*Primary Examiner*—Glenn A. Caldarola
*Assistant Examiner*—In Suk Bullock
*Attorney, Agent, or Firm*—The M. W. Kellogg Company

[57] ABSTRACT

The viscosity of quench oil circulated in a pyrolysis fractionation unit is controlled by contacting pyrolysis furnace effluent with a slip stream of 0.1–0.5 kg/kg of the quench oil, separating the resulting vapor-liquid mixture to remove tarry liquid, and feeding the remaining vapor to the fractionator. Removing the tarry liquid from the fractionator feed in this manner allows operation of the fractionator with less reflux, a higher bottoms temperature, and more heat recovery at a higher temperature.

12 Claims, 5 Drawing Sheets

QUENCH OIL VISCOSITY CONTROL IN PYROLYSIS FRACTIONATOR

FIELD OF THE INVENTION

The present invention relates to pyrolysis fractionators in olefin plants, and more particularly to a method for controlling the viscosity of quench oil in a pyrolysis fractionator configured for enhanced heat recovery.

BACKGROUND OF THE INVENTION

Pyrolysis furnaces are widely used to produce olefins such as ethylene. During the cracking of a hydrocarbon in a pyrolysis furnace, significant quantities of high-boiling hydrocarbons are produced, such as, for example fuel oil, gas oil, and gasoline, as well as lower molecular weight olefin products such as ethylene. The effluent from the furnace, after initial cooling, is introduced to a pyrolysis fractionation unit which removes the heavy end products from the furnace effluent, and recovers heat from the hot effluent stream.

A conventional pyrolysis fractionation unit is illustrated in FIG. 1. Briefly, the pyrolysis fractionation unit includes fractionator 10, fuel oil stripper 12, quench tower 14 and quench drum 16. The partially cooled effluent from the pyrolysis furnace is introduced via line 18 to a lower end of the fractionator 10. A bottoms stream 20 is supplied to the fuel oil stripper 12 where it is stripped by steam introduced via line 22. Steam and hydrocarbon vapor are returned to the bottom of the fractionator 10 via line 24. A fuel oil product 26 is withdrawn from the bottom of the fuel oil stripper 12 via line 26.

Quench oil is circulated from the fractionator 10 via line 28, passed through a series of coolers 30,32 for heat recovery, and returned to the fractionator 10 via respective lines 34,36. Pumps and filters (not shown) are conventionally used in line 28. The coolers 30,32 represent heat exchangers which recover heat for various uses, such as, for example, low pressure steam, dilution steam, plant process use, or the like. A gas oil draw 38 may also be taken from the fractionator 10 and introduced to the fuel oil stripper 12.

Overhead vapor 40 from the fractionator 10 is introduced to the quench tower 14. The vapor is quenched in quench tower 14 by means of water introduced via lines 42, 44 such that an overhead vapor stream 46 is obtained which is at a temperature of about 25°–40° C. Water and condensate from the quench tower 14 are supplied to the quench drum 16 by means of line 48. Water and hydrocarbons are separated in the quench drum 16 to obtain a heavy gasoline stream 50 and a reflux stream 52 which is returned to the top of the fractionator 10. Water is circulated from the quench drum 16 via line 54, cooled in heat exchangers 56,58 and returned to the quench tower 14 by means of lines 42,44 as previously described.

In the operation of this typical pyrolysis fractionation unit, it is desirable to withdraw gas oil draw 38. This reduces the amount of the reflux stream 52 required by the fractionator 10, increasing the amount of heat recovery and the level of heat recovery in exchangers 30,32. Unfortunately, a significant limit on the amount of the gas oil draw 38 is that the viscosity of the circulating quench oil in line 28 significantly increases as the quantity of gas oil draw 38 increases. This increases fouling and pressure drop in the exchangers 30,32.

It would be desirable to be able to lower the viscosity of the circulating quench oil in the pyrolysis fractionator to increase the quantity and level of heat recovery from the feed to the pyrolysis fractionator.

SUMMARY OF THE INVENTION

We have discovered that mixing a slip stream of circulating quench oil with the partially cooled furnace effluent, separating the resulting vapor and liquid, feeding the vapor stream to the fractionator, and withdrawing the liquid stream as a fuel oil product, will have the effect of reducing the viscosity of the circulating quench oil. Most or all of the liquid stream withdrawn as fuel oil product in this arrangement is a heavy, tarry material. By removing this heavy, tarry fraction from the pyrolysis fractionator, the viscosity of the circulating oil is considerably improved, and the tendency of the circulating oil to cause fouling at high temperatures in the heat recovery exchangers is also significantly reduced. This allows the heat recovery to occur at a higher temperature, with greater efficiency due to less fouling. In addition, the gas oil draw 38 can be increased to reduce reflux 52 requirements which allows more heat recovery from circulating oil in the exchangers 30, 32.

Briefly, the present invention provides a method for reducing the viscosity of quench oil in a pyrolysis fractionation unit of an ethylene plant. The method includes the following steps:

(a) introducing a vapor stream to a bottom of a pyrolysis fractionator;

(b) withdrawing liquid from the bottom of the pyrolysis fractionator;

(c) cooling a portion of the liquid from step (b) to form a quench oil;

(d) recirculating the quench oil to the pyrolysis fractionator to contact the vapor stream from step (a) and condense a portion of the vapor stream;

(e) contacting partially cooled effluent from a pyrolysis furnace with a portion of the liquid from step (b) in an effective amount to cool and condense a portion of the pyrolysis furnace effluent;

(f) separating vapor and liquid from the cooled pyrolysis furnace effluent from step (e) to form the vapor stream for step (a).

The viscosity of the liquid in steps (b) and (c) can be controlled by adjusting the amount of liquid supplied from step (b) to step (e). The liquid from step (b) supplied to step (e) can include a portion of the quench oil from step (c), and the viscosity of the quench oil can be controlled by adjusting the amount and temperature of the liquid supplied to step (e).

In a preferred embodiment, the method also includes the step of refluxing the pyrolysis fractionator overhead with heavy gasoline condensed from an overhead stream. The method also preferably includes the step of taking a gas oil draw from the pyrolysis fractionator, preferably also including stripping the liquid from step (f) together with the gas oil draw to obtain a stripped vapor stream, and introducing the stripped vapor stream to the pyrolysis fractionator. If desired, a portion of the liquid from step (b) can be stripped together with the liquid from step (f) and the gas oil draw.

The vapor-liquid separation step (f) can be effected in a vapor-liquid separator drum, or more preferably, in a chamber located within a bottom section of the pyrolysis fractionator.

The method of the present invention preferably includes the additional steps of:

(g) supplying overhead vapor from the pyrolysis fractionator to a quench tower;

(h) introducing quench water to the quench tower to contact and cool the vapor supplied in step (g); and (i) withdrawing and cooling water from a lower end of the quench tower for recirculation as the quench water in step (h).

The quench tower and pyrolysis fractionator can, if desired, be physically integrated into a single column.

DESCRIPTION OF THE INVENTION

Figure 2:
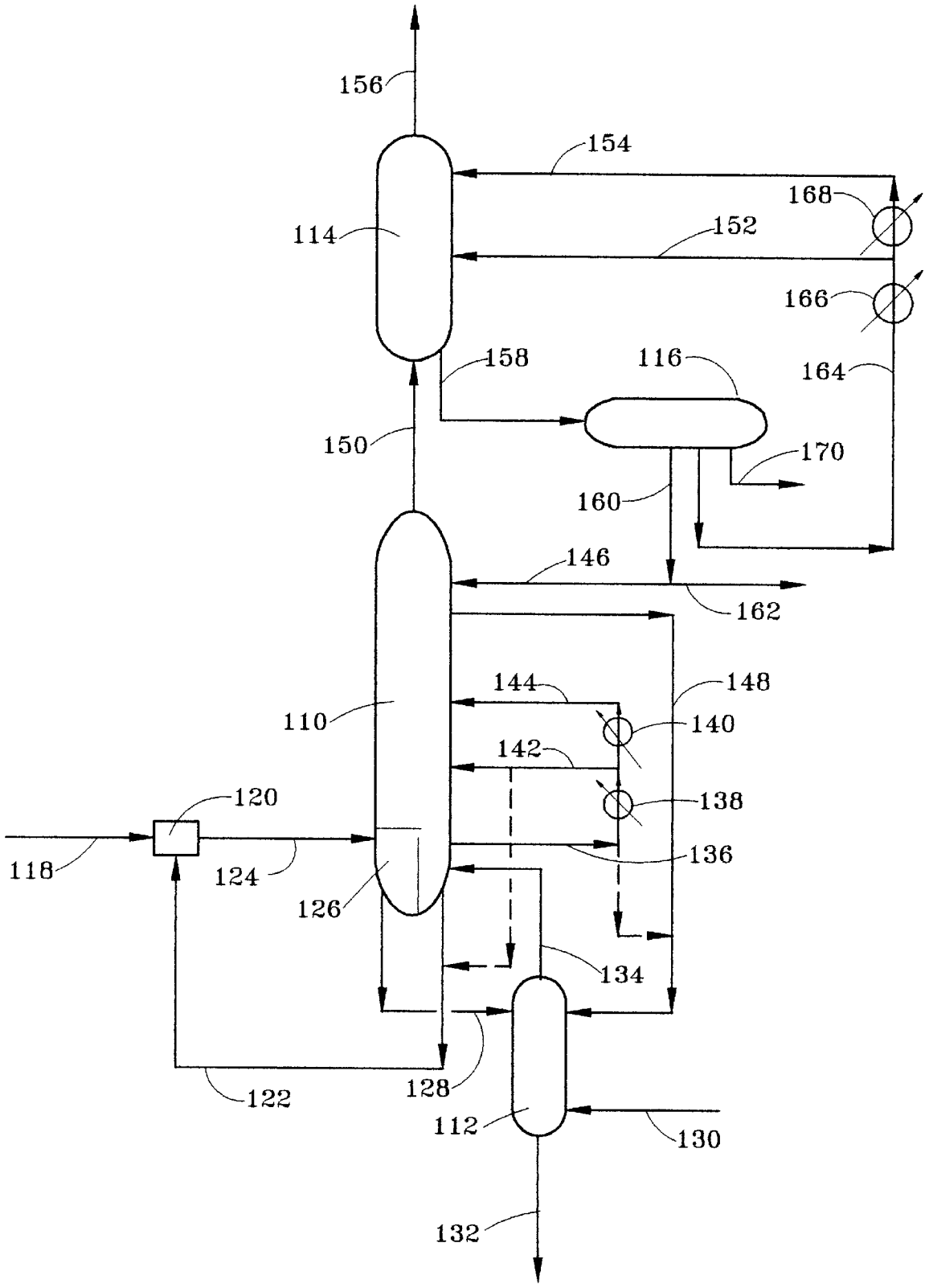
FIG. 2 is a simplified schematic process flow diagram illustrating a pyrolysis fractionator employing the quench oil viscosity control principle of one embodiment of the present invention wherein vapor-liquid separation is effected in a chamber located within the fractionator.

With reference to FIGS. 2–5 wherein like numerals are used to refer to like parts, the method of the present invention is effected in a pyrolysis fractionation unit shown in FIG. 2 which includes fractionator 110, fuel oil stripper 112, quench tower 114 and quench drum 116. The partially cooled effluent from the pyrolysis furnace (not shown) is introduced via line 118 to quench fitting 120 where it mixes with bottoms stream 122 comprising quench oil from the fractionator 110. The furnace effluent stream 118 is typically a vapor stream which has been partially cooled in a conventional transfer line exchanger, secondary quench exchanger, or the like, but still has a temperature above 300° C., e.g. 300°–600° C., typically 340°–450° C.

The weight ratio of the quench oil recycle stream 122 to furnace effluent stream in line 118 can be from 0.05 to 2 kg/kg, preferably from about 0.1 to about 0.5 kg/kg, depending on the relative temperatures and enthalpies of the streams and how much liquid is desired to be remove from the furnace effluent stream 118. The vapor-liquid mixture from the quench fitting 120 is supplied to a separate entry chamber 126 within the fractionator 110. In the chamber 126, the vapor is allowed to pass into the fractionator 110, and the liquid is withdrawn via line 128 and supplied to the fuel oil stripper 112. Pumps and filters (not shown) are typically used in lines 122,128 and 136.

Steam is introduced to the stripper 112 via line 130 to remove volatile components from the bottoms stream 132 which comprises a fuel oil product. Vapor from the fuel oil stripper 112 is returned to the fractionator 110 via line 134.

A quench oil stream 136 is withdrawn from the fractionator 110 adjacent to the bottom thereof, circulated through the coolers or heat exchangers 138,140 and returned to the fractionator 110 via respective lines 142,144. The circulating quench oil from lines 142,144 contacts the vapor from the chamber 126 as it rises through the fractionator 110 to condense the less volatile, higher molecular weight constituents thereof. A portion of the cooled quench oil can be introduced from line 142 into line 122 to lower the temperature of the oil in line 122. Reflux is provided to the fractionator 110 via line 146. A gas oil draw 148 is removed from the fractionator 110 adjacent an upper end thereof and introduced to the fuel oil stripper 112 via line 148. A portion of the quench oil from line 136 can also be introduced into line 148 for stripping in the stripper 112.

Overhead vapor from the fractionator 110 is introduced to a lower end of the quench tower 114 via line 150. Water is introduced to the quench tower 114 via lines 152,154 to remove hydrocarbons comprising a heavy gasoline fraction to yield a light hydrocarbon overhead product recovered via line 156 for further processing. Water and hydrocarbon condensate are supplied from the bottom of the quench tower 114 to the quench drum 116 via line 158. The quench drum 116 separates the bottoms 158 from the quench tower 114 into a heavy gasoline fraction which is recovered via line 160 and supplied as reflux to fractionator 110 via line 146 as described previously, and to heavy gasoline products line 162. A portion of the water separated in the quench drum 116 is recirculated via line 164, cooled in heat exchangers 166,168 and returned to quench tower 114 via lines 152,154 as previously described. Net process condensate from the quench drum 116 is recovered via line 170.

Figure 3:
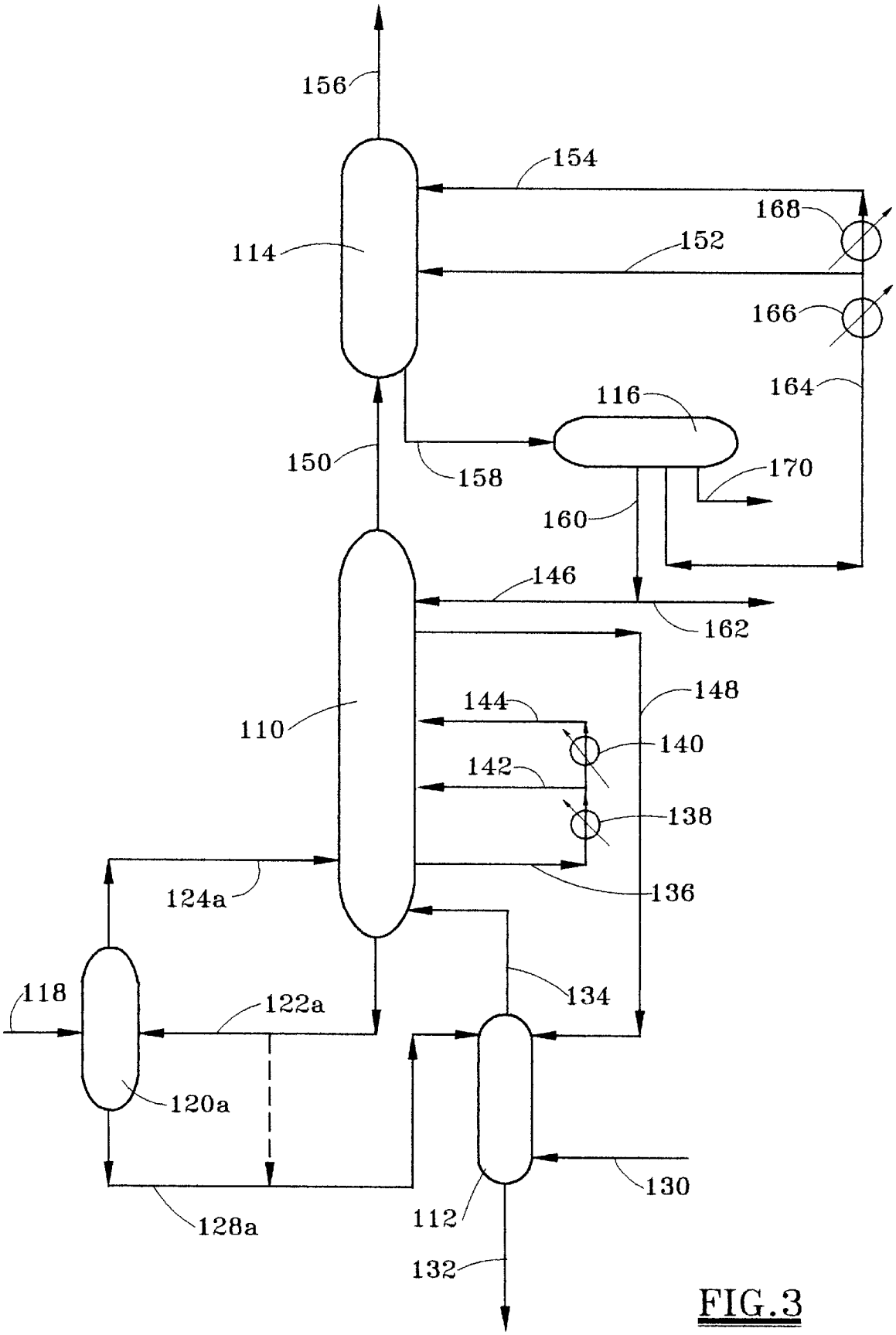
FIG. 3 is a simplified schematic process flow diagram of an alternative version of a pyrolysis fractionator employing the principle of quench oil viscosity control according to another embodiment of the present invention wherein the vapor-liquid separation is effected in a drum before introducing the vapor into the fractionator column.

In FIG. 3, the quench fitting 120 and chamber 126 from FIG. 2 are replaced with the vapor/liquid contactor-separator drum 120*a* which receives the recycled quench oil stream 122*a* and furnace effluent via line 118. The vapor is supplied directly to the bottom of the fractionator 110 via line 124*a*. The tarry liquid condensate is supplied from the vessel 120*a* via line 128*a* to the fuel oil stripper 112. In this embodiment, the vessel 120*a* effects a vaporliquid separation so that no modification of the fractionator 110 is required. This embodiment would be typical of a retrofit of an existing unit. If desired, a portion of the quench oil from line 122*a* can be introduced to the fuel oil stripper 112 by introduction of a portion thereof into line 128*a*.

Figure 4:
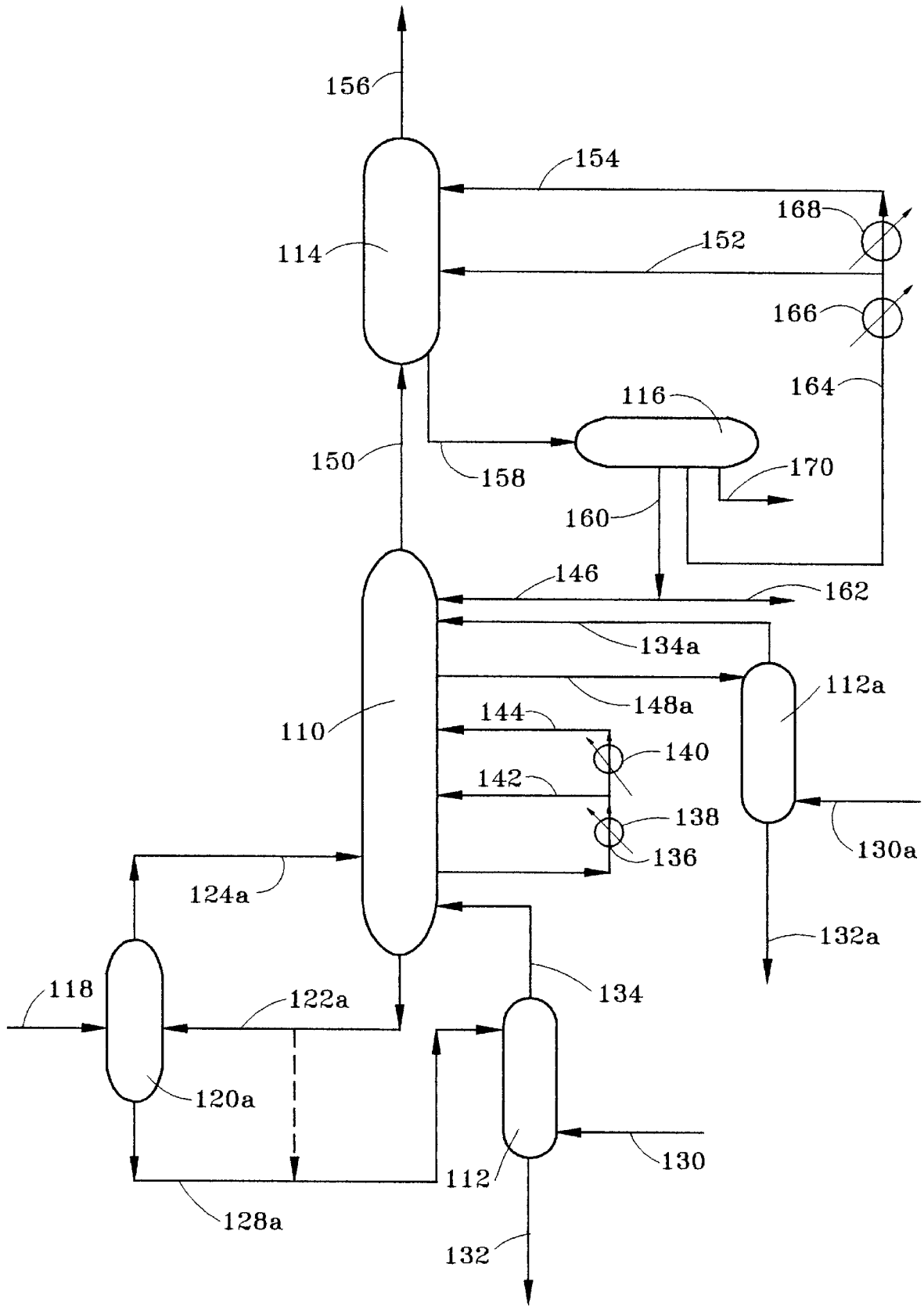
FIG. 4 is a simplified schematic process flow diagram of a pyrolysis fractionator using the principle of quench oil viscosity control according to another embodiment of the present invention wherein the gas oil draw is steam stripped in a stripper separate from the fuel oil stripper.

In FIG. 4, the gas oil draw 148*a* is supplied to a gas oil stripper 112*a* instead of to the fuel oil stripper 112 as in FIGS. 2 and 3. Steam is supplied to gas oil stripper 112*a* via line 130*a*. The stripped vapor and steam from the gas oil stripper 112*a* is returned to the fractionator 110 via line 134*a*. Stripped gas oil stream 132*a* is recovered from the bottom of the gas oil stripper 112*a*.

Figure 5:
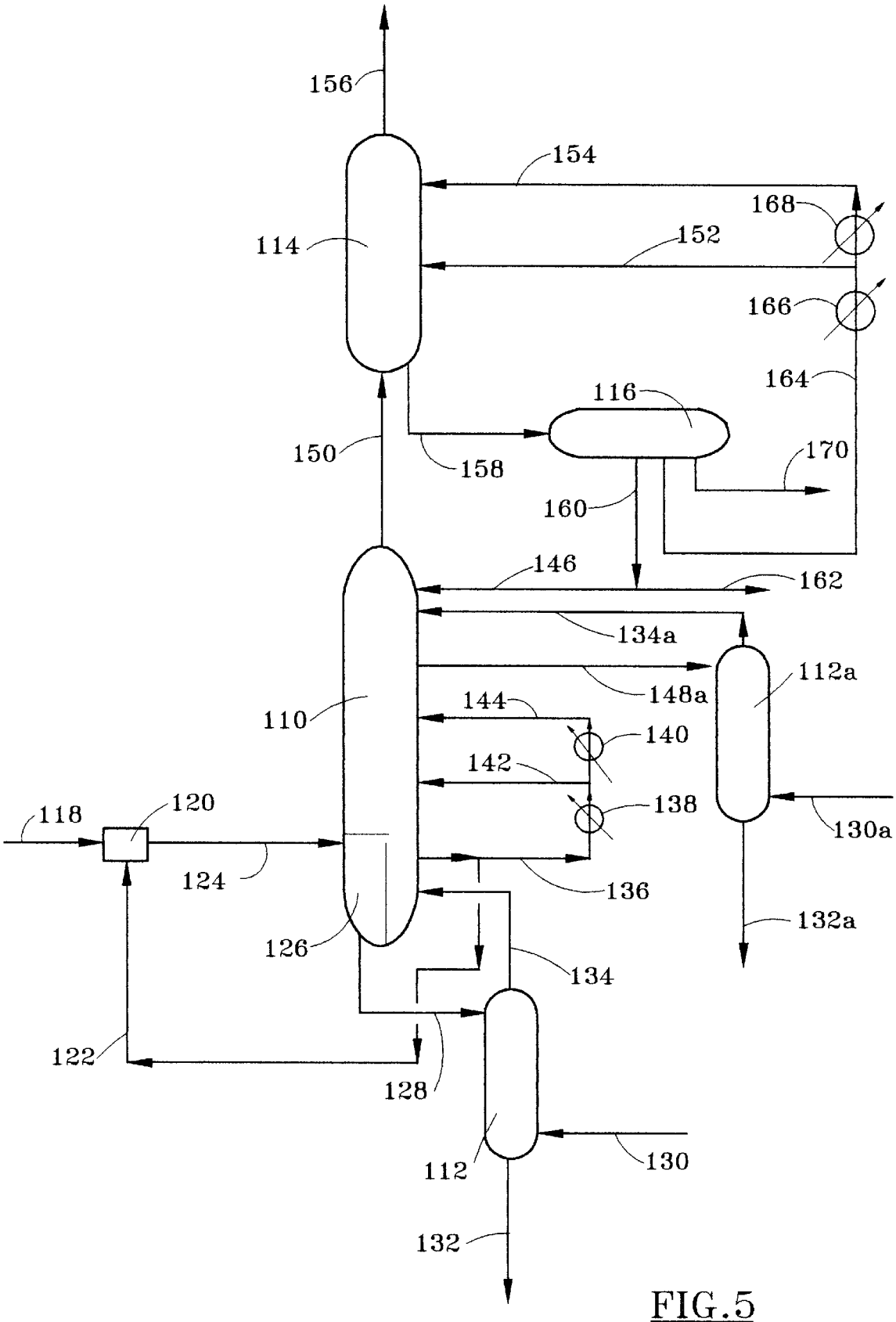
FIG. 5 is a simplified schematic process flow diagram of the pyrolysis fractionator employing the principle of the present invention of quench oil viscosity control according to another embodiment wherein vapor-liquid separation is effected in a chamber located within the fractionator and the gas oil draw is steam stripped in a stripper separate from the fuel oil stripper.

In FIG. 5, the pyrolysis fractionation unit includes the quench fitting 120/internal chamber 126 arrangement from FIG. 2, as well as the gas oil stripper 112*a* from FIG. 4.

The invention is illustrated by way of the following examples.

Example 1—Base Case/Gas Oil Draw

Figure 1:
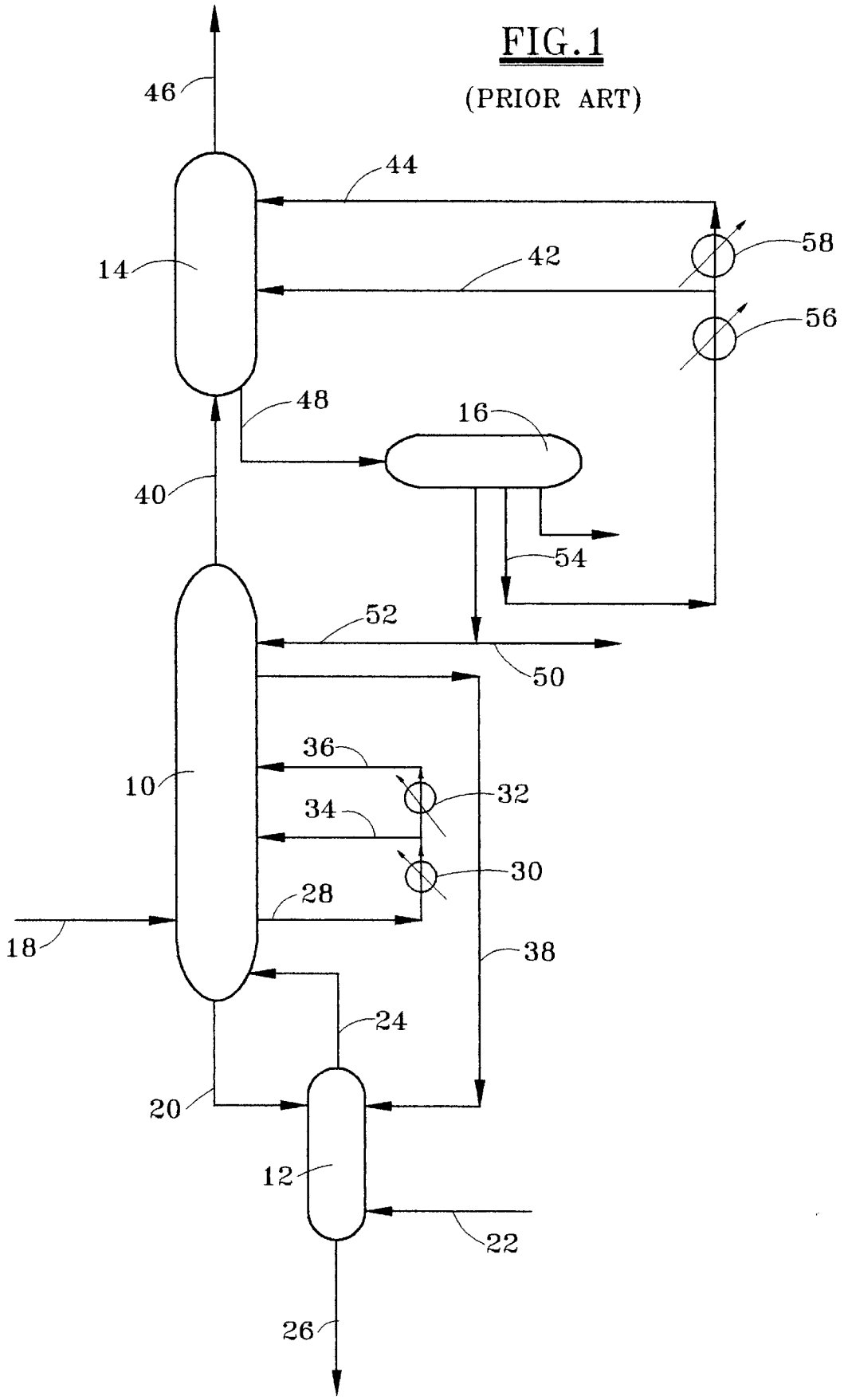
FIG. 1 (PRIOR ART)
FIG. 1 (prior art) is a simplified schematic process flow diagram for a typical pyrolysis fractionator.

A base case (see FIG. 1) was established by simulating an existing commercial pyrolysis fractionator receiving 336,700 kg/hr (13,670 kmol/hr) of partially cooled pyrolysis effluent at 343° C. and 0.4 kg/cm$^2$ gauge having the composition specified in Table 1.

TABLE 1

| Component | Composition (mol %) |
|---|---|
| $H_2$ | 7.31 |
| CO | 0.03 |
| $CO_2$ | 0.01 |
| $H_2S$ | 0.01 |
| $CH_4$ | 12.40 |
| $C_2H_2$ | 0.30 |
| $C_2H_4$ | 16.37 |
| $C_2H_6$ | 2.84 |
| $C_3H_4$ | 0.31 |
| $C_3H_6$ | 5.32 |
| $C_3H_8$ | 0.15 |
| 1,3-Butadiene | 1.47 |
| $C_4H_8$ | 1.05 |
| $C_4H_{10}$ | 0.29 |
| $C_{5+}$ | 4.59 |
| $H_2O$ | 47.55 |
| TOTAL | 100.00 |

The base case was simulated with (Example 1A) and without (Example 1B) a gas oil draw 38 of 894 kg/hr from the second stage of the fractionator 10, holding the temperature of the fractionator bottoms at 190° C. Without the draw, the fractionator bottoms 20 has a viscosity of 1.68 cp, the heavy gasoline product 54 has an endpoint of 242° C., reflux 52 to the fractionator 10 is 183,060 kg/hr (1500 kmol/hr), the quench drum 16 has a temperature of 85.2° C. and heat recovery in exchangers 30,32 is 24.0 MMkcal/hr. The results are tabulated in Table 2 below. With the gas oil draw 38, the fractionator bottoms 20 has a viscosity of 2.02 cp, the heavy gasoline product 54 has an endpoint of 243.5° C., reflux 52 is 123,320 kg/hr (1000 kmol/hr), the quench drum 16 temperature is 84.4° C. and heat recovery is 29.3 MMkcal/hr. The gas oil draw increased heat recovery, but undesirably increased the bottoms viscosity.

Example 2

The simulation of Example 1 was repeated for the process shown in FIG. 2. A draw 148 is taken from near the top of the fractionator 110 and sent to the top stage of the fuel oil stripper 112. A portion 122 of the quench oil is injected into the quench fitting 120 to mix with the furnace effluent 118, and the mixture 124 is separated into vapor and liquid. The vapor goes to the fractionator 110 and the liquid 128 goes to the top tray of the fuel oil stripper 112. The fractionator 10 bottoms stream 136 temperature was varied at 180°–200° C., the gas oil draw 148 was varied from 2000 to 3000 kg/hr, and the stripping steam 130 to the fuel oil stripper 112 was varied from 500 to 2025 kg/hr. The operating conditions and results are presented in Table 2.

In Example 2A the gas oil draw 148 flows at 2000 kg/hr from the second stage of the fractionator 110 to the top stage of the fuel oil stripper 112. The steam flowrate in line 130 to the fuel oil stripper 112 is 2025 kg/hr. The fractionator 110 bottoms temperature is 180° C., 10° C. cooler than in Example 1. A slip stream 122 of 33,000 kg/hr of fuel oil at 180° C. is mixed with the feed to the fractionator 110, reducing the temperature of the mixed stream 124 to about 322° C. The remaining liquid (condensed tar) is separated from the vapor in chamber 126 and sent via line 128 to the first stage of the fuel oil stripper 112. The flow rate of the fuel oil injection in line 122 was adjusted until most of the heaviest components ($C_{12+}$) were condensed. As a result, the viscosity of the fractionator bottoms (lines 122 and 136) decreased to 1.38 cp. The reflux (line 146) is also substantially lower than in Example 1A and heat recovery is substantially increased.

In Example 2B, the flow rate of stripping steam (line 130) was reduced to 1000 kg/hr. This resulted in a decrease in the heavy gasoline endpoint, suggesting that the fuel oil was overstripped in Example 2A, and requiring a higher reflux to meet the gasoline endpoint specification.

In Example 2C, the bottoms temperature in the fractionator 110 in the simulation of Example 2B was set at 190° C. This increased the concentration of heavier components and raised the viscosity to 1.7 cp, and reduced the gasoline endpoint to 242.8° C. The higher temperature in line 122 results in less tar condensate in line 128, and higher fuel oil viscosity in line 136.

In Example 2D, the simulation of Example 2C was modified to increase the flowrate of fuel oil to the quench fitting 120 to 36,000 kg/hr and reduce the steam 130 to the fuel oil stripper 112 to 500 kg/hr. Because more tar is condensed and removed via line 128, the viscosity in the fractionator bottoms drops to 1.43 cp and the stripping steam 130 is not needed to maintain low viscosity. The reflux 146 flowrate is 147,020 kg/hr and heat recovery is 27.2 MMkcal/hr.

In Example 2E, the simulation of Example 2D was modified by raising the fractionator 110 bottoms temperature to 200° C. The fuel oil viscosity increases to 1.6 cp and the gasoline endpoint goes up to 253° C.

In Example 2F, the simulation of Example 2E was modified by increasing the gas oil draw to 3000 kg/hr. The gasoline endpoint decreases, suggesting that increasing the gas oil draw reduces the reflux requirement. There is also a corresponding increase in fuel oil viscosity.

In Example 2G, the simulation of Example 2F was modified by increasing the reflux to match the gasoline endpoint of Example 1A. This resulted in a reflux flowrate of 151,860 kg/hr and a viscosity of 1.48 cp, both less than in the base case.

In Example 2H, the simulation of Example 2G was modified by reducing the gas oil draw to 2500 kg/hr. This resulted in a decrease of both the gasoline endpoint and the fuel oil viscosity, suggesting that the gas oil draw in Example 2G was too large and may have removed too much mid-boiling range material from the fractionator 110. The heat recovery is still 14.7% greater than the base case of Example 1A.

In Example 2I, the simulation of Example 2H was modified by reducing the gas oil draw to 1788 kg/hr, and the flowrate of the fuel oil to quench fitting 120 to 37,000 kg/hr. This increases the gasoline endpoint and the fuel oil viscosity, but the heat recovery is also increased.

In Example 2J, the simulation of Example 2H was modified by introducing the gas oil draw to the bottom stage of the fuel oil stripper 112. The result is that the gasoline endpoint drops to 237° C., but the viscosity increases to 1.6 cp.

TABLE 2

| Example | 1A | 1B | 2A | 2B | 2C | 2D | 2E | 2F | 2G | 2H | 2I | 2J |
|---|---|---|---|---|---|---|---|---|---|---|---|---|
| Temperature, Fractionator (110) Bottoms, °C. | 190 | 190 | 180 | 180 | 190 | 190 | 200 | 200 | 200 | 200 | 190 | 200 |
| Fuel Oil (122) Viscosity, cp | 1.68 | 2.02 | 1.38 | 1.47 | 1.7 | 1.43 | 1.6 | 1.99 | 1.48 | 1.35 | 1.44 | 1.6 |
| Heavy Gasoline Endpoint, °C. | 242 | 243.5 | 251 | 246 | 243 | 240 | 253 | 250 | 241 | 237.5 | 251 | 237 |
| Gas Oil Draw, kg/hr | 0 | 894 | 2000 | 2000 | 2000 | 2000 | 2500 | 3000 | 3000 | 2500 | 1788 | 2500 |
| Draw Stage | N/A | 2 | 2 | 2 | 2 | 2 | 2 | 2 | 2 | 2 | 2 | 2 |
| Fuel Oil Stripper (112) Stage | N/A | Top | Top | Top | Top | Top | Top | Top | Top | Top | Top | Bottom |
| Reflux (146), kmol/hr | 1500 | 1000 | 1100 | 1100 | 1200 | 1150 | 1150 | 1150 | 1250 | 1098 | 1098 | 1225 |
| Quench Oil (122) to Quench fitting, kg/hr | — | — | 33,000 | 33,000 | 33,000 | 36,000 | 33,00 | 38,700 | 38,700 | 38,700 | 37,000 | 38,700 |
| Tar Condensate (128), kg/hr | — | — | 4,100 | 4,200 | 3,000 | 4,400 | 4,200 | 4,800 | 4,600 | 4,600 | 4,400 | 4,700 |
| Fuel Oil Stripper (112) Steam (22,130), kg/hr | 2025 | 2025 | 2025 | 1000 | 1000 | 500 | 1000 | 500 | 500 | 500 | 500 | 500 |
| Quench Drum (16,116) Temperature, °C. | 85.2 | 84.4 | 84.4 | 84.1 | 84.4 | 84.3 | 84.4 | 84.4 | 84.4 | 84.3 | 84.1 | 84.2 |
| Heat Recovery (30,32,139,140), MMkcal/hr | 24.0 | 29.3 | 28.8 | 28.8 | 28.3 | 27.2 | 27.2 | 27.8 | 27.5 | 27.1 | 28.6 | 27.1 |

Example 3

The simulation of Example 2H was modified by sending the gas oil draw 148*a* to additional stripper 112*a* as shown in FIG. 5. The overhead vapor 134*a* is returned to the draw stage (the second stage) and a gas oil product stream 132*a* is obtained. The stripper 112*a* is reboiled with 250 kg/hr of steam. With a reflux 146 of 148,320 kg/hr, the gasoline endpoint is 237° C. and the fuel oil viscosity is 1.88 cp. The results are presented in Table 3. This shows how the principles of the present invention can be suitably applied to obtain a lighter gas oil product.

TABLE 3

| Example | Base | 3 |
|---|---|---|
| Temperature, Fractionator (10,110) Bottoms, °C. | 190 | 200 |
| Fuel Oil Viscosity, cp | 1.68 | 1.88 |
| Gasoline Endpoint, °C. | 242 | 237 |
| Gas Oil Draw, kg/hr | 0 | 2500 |
| Draw Stage | N/A | 2 |
| Fuel Oil Stripper 112 Stage | N/A | Bottom |
| Reflux (52,146), kmol/hr | 1150 | 1225 |
| Recycle (122), kg/hr | 0 | 38,700 |
| Condensate, kg/hr | 0 | 4800 |
| Steam (22,130), kg/hr | 2025 | 500 |
| Heat Recovery, MMkcal/hr | 24.0 | 27.6 |

Example 4

The process of FIG. 5 was simulated based on 336,000 kg/hr furnace effluent in line 118, a recycle of 61,000 kg/hr in line 122, and recovery of 5800 kg/hr of tar in line 128. The fuel oil stripper 112 was operated with 500 kg/hr steam via line 130 and produced 5650 kg/hr of fuel oil. The gas oil draw 148*a* was 2450 kg/hr, the stripper 112*a* was operated with 200 kg/hr, steam via line 130*a* and produced 2360 kg/hr steam via line 130*a*. The reflux 146 was 146,000 kg/hr. Heat recovery in exchangers 138,140 was 27.3 MMkcal/hr, and the quench oil in lines 122,136 was 200° C. and had a viscosity of 1.6 cp.

The present invention is described above to serve as an illustration of the invention, and not as a limitation thereon. Various modifications will be apparent to those in the art in view of the foregoing. It is intended that all such modifications within the scope and spirit of the present invention be embraced by the appended claims.

We claim:

1. A method for controlling the viscosity of quench oil in a pyrolysis fractionation unit of an ethylene plant, comprising the steps of:

(a) introducing a vapor stream to a bottom of a pyrolysis fractionator;

(b) withdrawing liquid from the bottom of the pyrolysis fractionator;

(c) cooling a portion of the liquid from step (b) to form a quench oil;

(d) recirculating the quench oil to the pyrolysis fractionator to contact the vapor stream from step (a) and condense a portion of the vapor stream;

(e) contacting effluent from a pyrolysis furnace with a portion of the liquid from step (b) in an effective amount to cool and condense a portion of the pyrolysis furnace effluent;

(f) separating vapor and liquid from step (e) to form the vapor stream for step (a).

2. The method of claim 1 wherein the viscosity of the liquid from step (b) is controlled by adjusting the amount of liquid supplied from step (b) to step (e).

3. The method of claim 1 wherein the liquid from step (b) supplied to step (e) includes a portion of the quench oil from step (c), and wherein the viscosity of the quench oil is controlled by adjusting the amount and temperature of the liquid supplied to step (e).

4. The method of claim 1, further comprising the step of refluxing the pyrolysis fractionator overhead with heavy gasoline condensed from an overhead stream.

5. The method of claim 4, further comprising the step of taking a gas oil draw from the pyrolysis fractionator.

6. The method of claim 5, further comprising the steps of (1) stripping at least a portion of the liquid from step (f) together with at least a portion of the gas oil draw to obtain a stripped vapor stream, and (2) introducing the stripped vapor stream to the pyrolysis fractionator.

7. The method of claim 1, further comprising the steps of (1) stripping at least a portion of the liquid from step (f) to obtain a stripped vapor stream, and (2) introducing the stripped vapor stream to the bottom of the pyrolysis fractionator.

8. The method of claim 6 wherein a portion of the liquid from step (b) is stripped in step (1) together with the liquid from step (f) and the gas oil draw.

9. The method of claim 7 wherein a portion of the liquid from step (b) is stripped in step (1) together with the liquid from step (b).

10. The method of claim 1 wherein step (f) is effected in a chamber within the pyrolysis fractionator adjacent the bottom thereof.

11. The method of claim 1, further comprising the steps of:

(g) supplying overhead vapor from the pyrolysis fractionator to a quench tower;

(h) circulating quench water from a bottom of the quench tower to a top of the quench tower to contact and cool the vapor supplied in step (g); and (i) cooling the quench water in step (h) to recover heat.

12. The method of claim 11 wherein the quench tower and pyrolysis fractionator are physically integrated in a single column.

* * * * *